US006253721B1

(12) United States Patent
Mayer et al.

(10) Patent No.: US 6,253,721 B1
(45) Date of Patent: Jul. 3, 2001

(54) SWIVEL-MOUNTED CAM FOLLOWER FOR A VALVE DRIVE OF AN INTERNAL COMBUSTION ENGINE

(75) Inventors: Wolfgang Mayer, Seukendorf; Helmut Engelhardt, Herzogenaurach; Walter Speil, Ingolstadt, all of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/429,247

(22) Filed: Oct. 29, 1999

(51) Int. Cl.[7] ..... F01L 1/18

(52) U.S. Cl. ..... 123/90.39; 123/90.41; 123/90.42; 74/559

(58) Field of Search ..... 123/90.39, 90.41, 123/90.42, 90.43, 90.44, 90.46; 74/519, 559, 569

(56) References Cited

U.S. PATENT DOCUMENTS 5,775,280 * 7/1998 Schmidt et al. ..... 123/90.41
5,979,383 * 11/1999 Faville et al. ..... 123/90.36
6,035,820 * 3/2000 Engelhardt et al. ..... 123/90.41
6,062,184 * 5/2000 Engelhardt et al. ..... 123/90.41

* cited by examiner

*Primary Examiner*—Weilun Lo
(74) *Attorney, Agent, or Firm*—Volpe & Koening, P.C.

(57) ABSTRACT

A cam follower (1) is proposed, which is made from a sheet metal material, and has a profile that is U-shaped in cross-section. In the area of its one end (6), its side walls (2) taper conically. At the same time, straps (7) for guiding a shaft end of a gas exchange valve are provided on an underside (5) of the cam follower (1) as an extension of the side walls (2) and are bent by 180° to fit on the underside (5) in the area of the end (6). A cam follower (1) of this type is made in a simple way, has an excellent guide possibility for the shaft end of the gas exchange valve, and has a smaller mass with a smaller mass moment of inertia than cam followers that have been used until now.

5 Claims, 1 Drawing Sheet

SWIVEL-MOUNTED CAM FOLLOWER FOR A VALVE DRIVE OF AN INTERNAL COMBUSTION ENGINE

BACKGROUND OF THE INVENTION

The invention involves a swivel mounted cam follower of a valve drive of an internal combustion engine having the following characteristics:

a) the cam follower has thin walls and is constructed in a finger shape and has selectively parallel side walls with a crosspiece connecting them;

b) the side walls form with the crosspiece, at least in the area of the ends of the cam follower, a profile having a U-shaped cross-section and they enclose an intermediate space;

c) the cam follower acts at one end via an underside of the crosspiece on a shaft end of a gas exchange valve and d) two spaced apart straps extend from the end and the shaft end of the gas exchange valve is guided between them.

A cam follower of this general type is known from the patent EP-PS 05 73 674. It is disadvantageous in this cam follower that it has a separate insert piece in the area of the tightly fitting valve shaft (see FIG. 1). This increases in a disadvantageous way the manufacturing expense in making this type of cam follower. In addition, it is designed to be relatively wide. For this reason, it has a comparatively large mass and thus an unfavorable mass moment of inertia. This unnecessarily increases the valve drive friction.

The insert piece described above has only a relatively small guide height for the tightly fitting valve shaft. It would be desirable, for many applications, however, to have a larger guide height by which advantageously a falling down of the cam follower is prevented during its pre-mounted state in the cylinder head of the internal combustion engine or by which this cam follower is fixed in position extremely well during its use in the operating state of the internal combustion engine.

SUMMARY OF THE INVENTION

The purpose of the invention is thus to create a cam follower of the type described above, in which the cited disadvantages are eliminated and which can be manufactured in a simple manner especially having a small mass and at the same time guarantees an excellent guide of a shaft end of a gas exchange valve.

According to the invention, this purpose is achieved by providing a pivotable cam follower having the features noted below, which are used to improve this arrangement, and are an advance over the known cam followers.

According to the invention, the straps are constructed as an extension of the side walls that is bent by 180° onto the underside, where the underside of the side walls is turned away from the intermediate space, and the side walls are, in the area of the end, minimized in their separation distance or taper in this area selectively in a conical manner, such that they are set off at equal separation distances outside of the end.

Since the side walls in the area of the end that covers a longest arc during pivoting, are minimized in their separation distance, a cam follower having a smaller mass and thus a smaller mass moment of inertia as well as a clearly higher rigidity in the area of the valve seat, than the cam follower known from the state of the art, is created. At the same time, the straps should be manufactured as an extension of the side walls, which proves to be especially favorable in production manufacturing. A guide height for the shaft end of the gas exchange valve to be enclosed can be determined by the selection of the length and width of the straps.

Of course, a cam follower is also included within the protective scope of this invention, which has side walls that are designed not necessarily at equal distances or having straps that are bent by an angle deviating by 180° in the direction toward the underside.

In the further development of the invention, the cam follower is to be manufactured out of a sheet metal material, where, for example, it is manufactured from a blank by cold forming. A cam follower made out of a sheet metal material of this type proves to be relatively cost-effective. However, conceivably and included within the protective scope of this invention, are all other materials which can be made in the proposed shape, thus also plastics or fiber and/or particulate reinforced plastics are included.

In an advantageous way, the contour of the cam follower and thus also the contour of the straps are formed by blanking presses. If one were to shape the straps out of the cross-strap, their final geometry would have to be disadvantageously pressed later. Because of the shaping of the straps out of the side walls, smooth contact surfaces are present to guide the valve shaft, since no punch outline occurs in this area. Expensive reworking can be rendered unnecessary.

A simple measure for a connection of the straps with the underside of the cam follower is disclosed. According to it, each strap is to have a nub, or similar piece, bent at a right angle in the direction towards the underside. This nub is preferably formed during a punch operation of the cam follower and after a bending of the straps to the underside, it is welded to this underside.

Finally, it is proposed to position in the cam follower a roller set selectively in roller bearings as a component running counter to the cam. In this way, the friction in the valve drive is further minimized compared to the slide calipers used until now. However, a roller set in slide bearings or possibly a slide caliper would also be conceivable.

Since the straps are to be made having a height that is greater than the thickness ofthe sheet metal, an excellent guide for the valve shaft is possible because of the largely adjustable height.

As a cam follower, dragging, tilting or swinging levers are provided. These can also act on several gas exchange valves at the same time and thus be constructed, for example, in a finger or fork shape. Likewise, the cam follower can be inserted into a switchable lever drive, or this drive can have a hydraulic play compensation component.

BRIEF DESCRIPTION OF THE SEVERAL VIEWS OF THE DRAWING

The invention is expediently explained in greater detail using the drawing. Shown are.

DETAILED DESCRIPTION OF THE INVENTION

Figure 1:
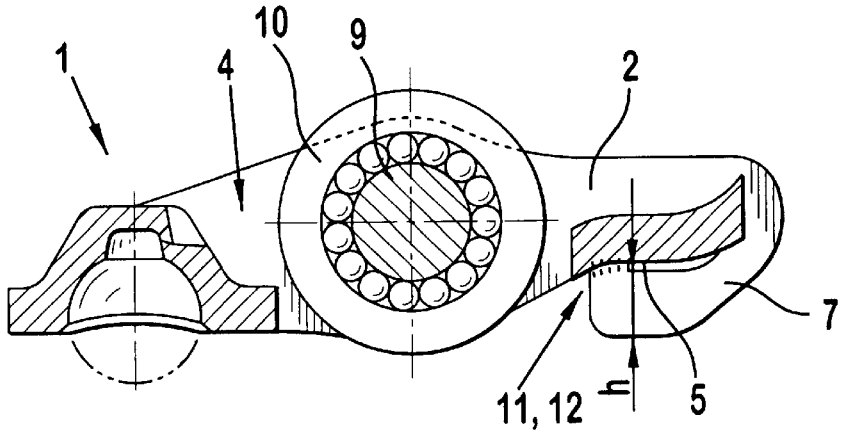
FIG. 1 is a longitudinal section through a cam follower according to the invention and the FIGS. 2, 3 are overhead views of the cam follower according to FIG. 1.
Figure 2:
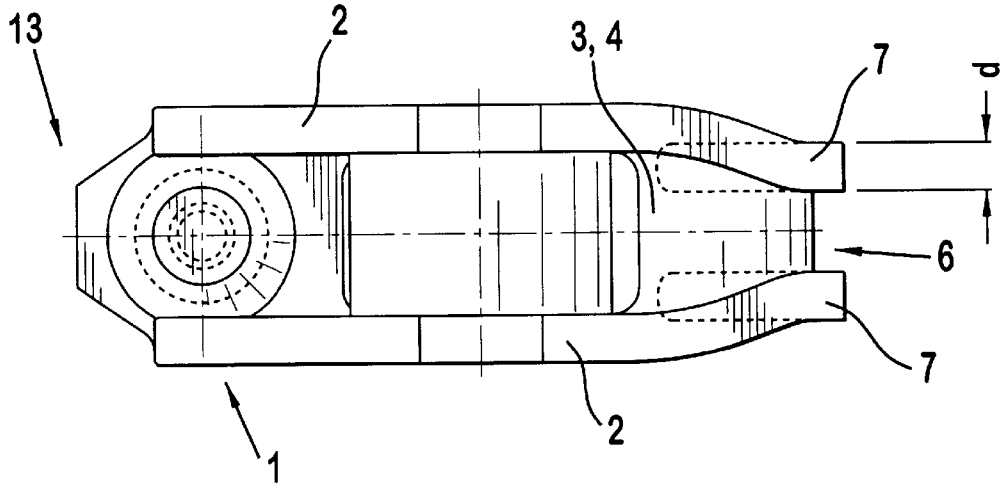

The Figures show a cam follower 1, which is manufactured from a sheet metal material and has a finger-shaped geometry. A crosspiece 3 runs between its parallel side walls 2. This crosspiece 3 connects the side walls 2, such that a profile that is U-shaped in cross-section results, which encloses an intermediate space 4. A shaft end of a gas exchange valve that is not depicted fits in the area of one end 6 on an underside 5 of the cam follower 1 that faces away from the intermediate space 4. This gas exchange valve is supported between two straps 7, which also run on the underside 5.

The side walls 2 have bores 8 that are in alignment with each other, into which an axle 9 is inserted. On this axle 9 runs a roller bearing supported roller 10. A cam of a camshaft, not shown, is in contact with the roller 10. In the area of the other end 13, the cam follower 1 is supported on a head of a support element, not shown.

The straps 7 extend as a single piece as an extension of the side walls 2 and are bent by 180° here onto the underside 5 in the area of the end 6. At the same time, the cam follower 1 in the area of the end 6 becomes reduced in its width, such that here the side walls 2 are manufactured in this area to be conically tapering. Other reductions are also conceivable, however, such as graduated reductions of the width of the side walls 2 in the area of the end 6. However, it is also conceivable and planned to manufacture only partial areas of a height or length of the side walls 2 to be conically tapering.

As shown more clearly in FIG. 1, the straps 7 each have on their ends a nub 11. Using this nub 11, the straps 7 are connected via a welded connection 12 to the underside 5 of the cam follower 1, for example. However, other connection possibilities are also conceivable, such as adhering, latching, or the like, or this connection can be completely omitted when the stability is appropriate.

Figure 3:
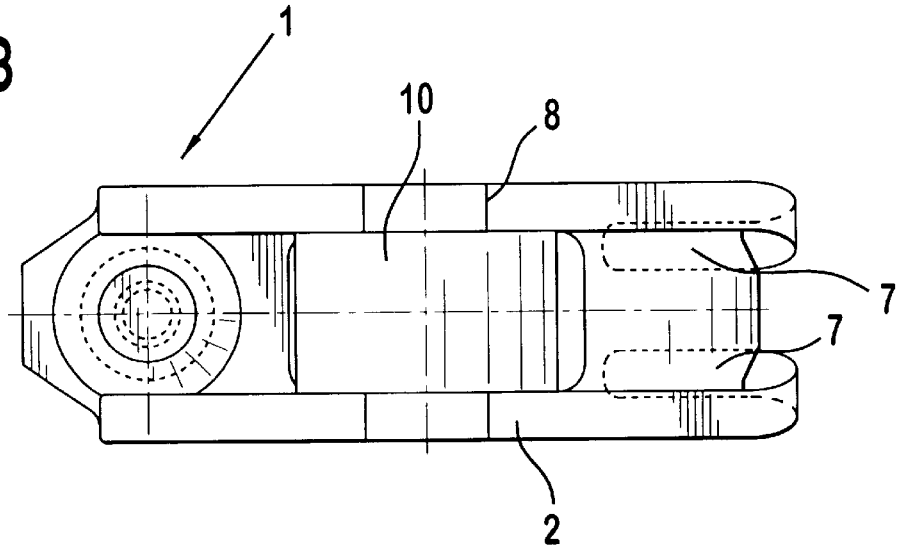

FIG. 3 shows a cam follower 1 as described above, where, however, here its side walls 2 are manufactured set apart at an equal distance over its entire extension. Only the straps 7 on the underside S are drawn inwards and thus reduced in their distance in comparison with the side walls 2.

It is not shown that the straps 7 can be punched out of the side walls 2 in such a way that they run at an angle in the direction to the underside 5. If the straps 7 are finally bent to the underside 5, then they are less susceptible to tear formation in the bending area.

What is claimed is:

1. Swivel-mounted cam follower (1) of a valve drive of an internal combustion engine having the following features:

a) the cam follower (1) has thin walls and is constructed in a finger shape and has side walls (2) with a crosspiece (3) connecting the side walls (2) together, the side walls (2) being parallel over at least a portion of a length thereof;

b) the cam follower having two ends (6, 13), the side walls (2) form with the crosspiece (3), at least in an area of the ends (6, 13) of the cam follower, a profile with a U-shaped cross-section that encloses an intermediate space (4);

c) the cam follower (1) acts at one end (6) via an underside (5) of the crosspiece (3) on a shaft end of a gas exchange valve;

d) two spaced apart straps (7) extend from the end (6), and the shaft end of the gas exchange valve is guided between them; characterized by the following features:

e) the straps (7) are constructed as an extension of the side walls (2) that are bent by 180° to the underside (5), the underside (5) being opposite from the intermediate space (4), the straps (7) not being connected to the crosspiece in the end area of the side walls (2); and f) 2 the side walls (2) are minimized in separation distance or taper in the area of the end (6), and are set off at an equal separation distances outside of the end (6).

2. Cam follower according to claim 1, characterized in that the cam follower (1) is made out of a sheet metal material, where it is manufactured from a blank by cold forming.

3. Cam follower according to claim 2, characterized in that on the end of each strap (7), a nub (11) extends at a right angle in the direction towards the underside (5), and this nub (11) is selectively formed during a punch operation of the blank and that the straps (7) are welded via the nubs (11) to the underside (5).

4. Cam follower according to claim 2, characterized in that a height (h) of the straps (7) is designed larger at least in partial areas, than a thickness (d) of the blank.

5. Cam follower according to claim 1, characterized in that an axle (9) is arranged with a roller (10) selectively set in roller bearings, as a component running counter to a cam, in bores (8) of the side walls (2), which are in alignment with each other.

* * * * *